US005390379A

United States Patent [19]

Palmer, Jr. et al.

[11] Patent Number: 5,390,379

[45] Date of Patent: Feb. 21, 1995

[54] PERSON CONVEYOR

[76] Inventors: John M. Palmer, Jr., P.O. Box 115, Lutz, Fla. 33549; John M. Palmer, III, P.O. Box 823291, Dallas, Tex. 75382

[21] Appl. No.: 817,333

[22] Filed: Jan. 6, 1992

[51] Int. Cl.[6] ..... A61G 7/00

[52] U.S. Cl. ..... 5/81.1

[58] Field of Search ..... 5/81.1, 86.1, 88.1, 5/600

[56] References Cited

U.S. PATENT DOCUMENTS

| | | | |
|---|---|---|---|
| 3,593,351 | 7/1971 | Dove | 5/81.1 |
| 3,769,642 | 11/1973 | Warman | 5/81.1 |
| 3,854,152 | 12/1974 | Chez | 5/81.1 |
| 3,886,005 | 6/1975 | Harris | 5/81.1 |
| 4,087,873 | 5/1978 | Ohkawa | 5/81.1 |
| 4,327,453 | 5/1982 | Sefton | 5/81.1 |
| 4,459,712 | 7/1984 | Pathan | 5/81.1 |
| 4,776,047 | 10/1988 | DiMatteo | 5/81.1 |
| 4,837,873 | 6/1989 | DiMatteo et al. | 5/81.1 |
| 4,868,938 | 9/1989 | Knouse | 5/81.1 |
| 5,048,133 | 9/1991 | Iura et al. | 5/81.1 |

FOREIGN PATENT DOCUMENTS 4459712 of 1984 United Kingdom ..... A61G 7/08

*Primary Examiner*—Alexander Grosz

[57] ABSTRACT

A person conveyor system (20) for transporting its user transversely across either a flat bed or an articulating bed (30). Drive rollers (42 and 46) on each side of the bed move a conveyor belt (48) on which a traveling mattress (50) is attached. Generally, a primary unit supports the user's torso. Optionally, one or two additional units may support the users legs and/or head. When two or more units are incorporated in the system, by cross controlling the units the user can partially rotate his or her body about the surface of the bed.

4 Claims, 7 Drawing Sheets

PERSON CONVEYOR

BACKGROUND—FIELD OF INVENTION

This invention relates to equipment used in homes, nursing homes, and hospitals for moving patients about and on and off beds.

BACKGROUND—DESCRIPTION OF THE PRIOR ART

Many ambulant disabled, invalid, and elderly persons are generally capable of caring for themselves. They move slowly getting into and out of their wheelchairs and walkers. With much effort they are able to transfer from their mobility aids to the edge of their beds. Unfortunately, for many they cannot raise their legs upon the bed or move to the center of the bed. There are literally thousands of persons in this condition, they sleep on the very edge of their beds for years. It is not uncommon for one to roll off the bed and suffer serious injury from the fall.

As an patient turns the 90 degrees from a sitting position on the edge of a bed to a longitudinal supine position his or her bed clothing becomes twisted and uncomfortable. This is especially true if the individual is wearing a gown, and it is practically impossible to straighten as a result of their weakened condition.

Further, the process of changing bed sheets is a labor intensive and unpleasant task. Many times only a small area of the sheet is soiled but the entire sheet must be removed and laundered. In institutions, one or more attendants is required to move a patient about the bed for changing sheets.

Previous attempts to implement equipment for moving a person laterally across a bed have been less than satisfactory. Those beds having articulating head and foot positions required they be in the flat position while preforming a transfer. This requires additional time and the loss of the user's preferred position.

Further, equipment available today is very expensive and still does not solve the problems previously mentioned. There is no equipment available on the market for use on conventional beds. The prior art associated with achieving the above objectives as in DiMatteo, U.S. Pat. Nos. 4,776,047, 4,796,313 and Knouse, U.S. Pat. No. 4,868,938 have been mainly concerned with the needs of non-ambulatory patients who require attendants to assist them and to operate the equipment. Whereas, our invention is directed toward those patients still partially ambulatory and are desiring and able no operate the equipment themselves. Equipment of the prior art suffer from a number of disadvantages:

(a) Their equipment consist of many complicated mechanical and electrical components resulting in very expensive manufacturing cost.

(b) Due to the large number of parts in their equipment sanitizing it between users is time consuming and costly.

(c) Use of their equipment generally requires at least one trained attendant.

(d) Bed sheets used for their equipment must be even larger than standard sheets. They must be approximately twice as wide as a standard sheet to travel across the bed and an additional amount to wrap several turns around the drive rollers. Considering that generally only a small area of the sheet is soiled, their oversized sheet is a serious waste.

(e) Their equipment has no provision for a short sheet that could be used just for the areas of a bed that are frequently soiled.

(f) The moving of a soiled sheet across the mattress of their equipment, while moving a patient across the bed, soils an expanded area on the mattress.

(g) The wrapping of a soiled sheet around their drive rollers soils the rollers and they require cleaning.

(h) Pulling the sheet across their mattress creates friction causing wear on the sheet and the mattress. This friction is uncomfortable for the patient.

(i) Their systems do not provided features to aid in the rotating of a patient about the surface of the bed.

(j) As weakened patients transfer from their wheelchairs or walkers to their bed they frequently fall onto the bed from exhaustion. Since there is no mattress over the rollers at the edge of the bed on the equipment of the prior art it is possible for a user to break a hip upon falling onto the bed's edge.

(k) As the weakened patient transfers from his or her bed to a wheelchair they frequently fall onto the wheelchair from exhaustion. In the process their legs swing up and hit the bed structure causing abrasions and cuts. Equipment of the prior art does not address this problem.

(l) Their equipment does not work satisfactorily unless the surface of the bed is flat. In the hospital environment the time required to raise and lower the head section of an articulating bed, each time a sheet is soiled, is prohibitive.

(m) To adapt their equipment for use on a conventional bed considerable modification to the bed frame must to be performed.

(n) They do not provide for the use of the existing driving or control means from the articulating bed on which their equipment is mounted for driving and controlling the conveying system.

(o) Their control means are designed for an attendant to operate rather than for the person using the bed.

(p) Their equipment is not designed for mounting of multiple units on a single bed thus preventing powered rotation of the patient about the surface of the bed by cross controlling of the units.

OBJECTS AND ADVANTAGES

Accordingly, in addition to overcoming the objections of the prior art as previously described additional objects and advantages of the present invention are:

(a) to provide a person conveyor system for use on a bed so that the user may be moved across the bed;

(b) to provide a person conveyor system which the user can control without the assistance of others;

(c) to provide a person conveyor system which has the mattress placed on top of all hard mechanical equipment;

(d) to provide a person conveyor system which can be mounted on a conventional bed without extensive modification to the bed frame;

(e) to provide a person conveyor system which contains a minimum of parts so as to keep the manufacturing cost at a minimum and to reduce the time and labor required for sanitizing;

(f) to provide a person conveyor system which works as well on an articulating bed as it does on a flat bed;

(g) to provide a person conveyor system which can be powered and controlled by the driving and control means from the bed on which the conveyor system is mounted;

(h) to provide a person conveyor system which has provisions in the traveling mattress for allowing the users torso to rotate about the surface of the bed;

(i) to provide a person conveyor system consisting of a plurality of conveying units which by cross controlling the units the patient can be partially rotated about the surface of the bed;

(j) to provide a person conveyor system which requires small sheets compared with conventional sheets and with those used on equipment of the prior art;

(k) to provide a person conveyor system which does not create a soiled area on the mattress due to moving a soiled sheet across the bed;

(l) to provide a person conveyor system in which the idling and drive rollers are not soiled due to moving a soiled sheet across the bed. The bed sheets of the present invention are not in contact with the rollers;

(m) to provide a person conveyor system which does not require pulling the sheet across the mattress, thereby eliminating wear on the sheet and mattress and discomfort to the patient.

(n) to provide a person conveyor system which has protective means to prevent a user from injuring his or her legs and feet on the bed structure and the conveyor system while transferring from the bed to a wheelchair or other device;

Further objects and advantages will become apparent from a consideration of the ensuing description and drawings.

DRAWING FIGURES

Figure 15:
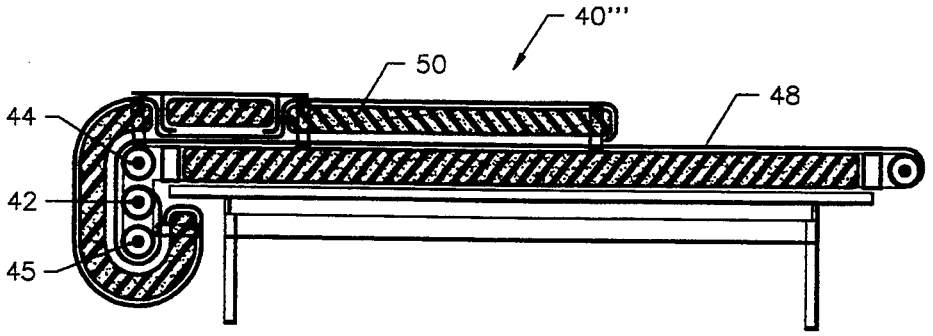
Figure 16:
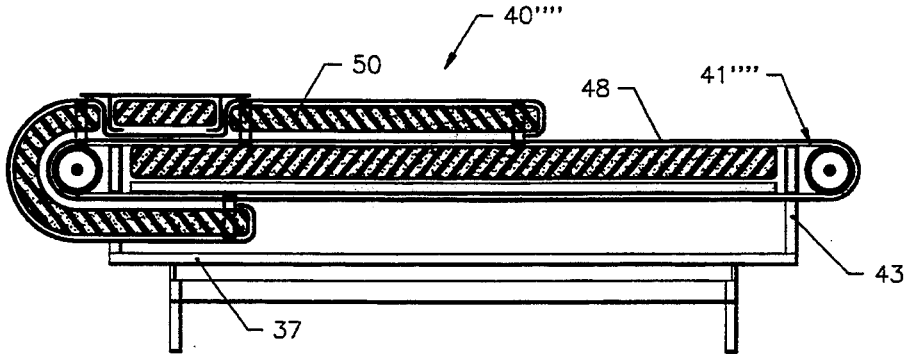
Figure 17:
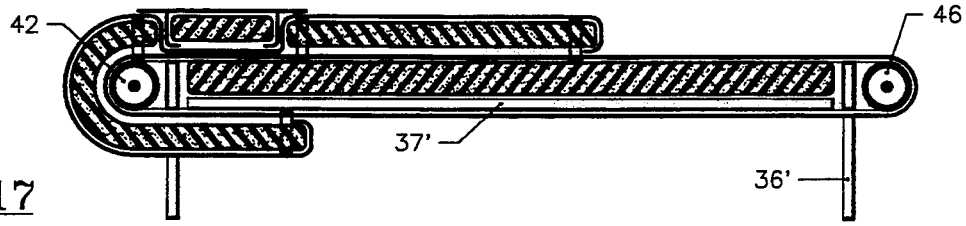

FIGS. 15, 16, and 17 are additional alternate transverse sectional elevation views.

Figure 12:
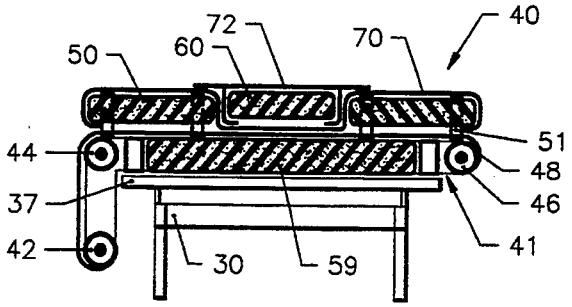
FIG. 12 is a sectional elevation view of the conveyor of FIG. 1 showing a transverse view.
Figure 18:
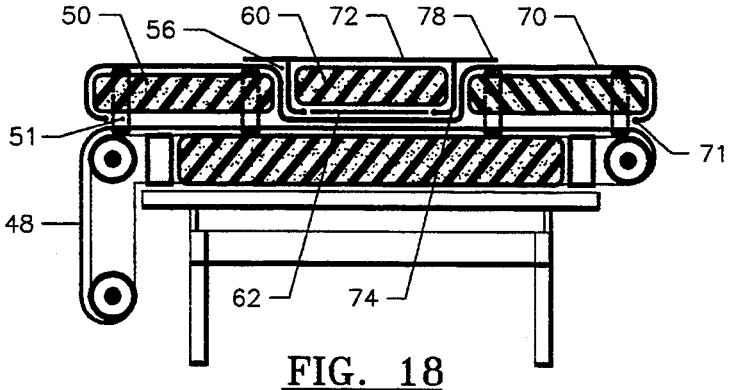

FIG. 18 is an enlarged sectional elevation view of FIG. 12.

Figure 19:
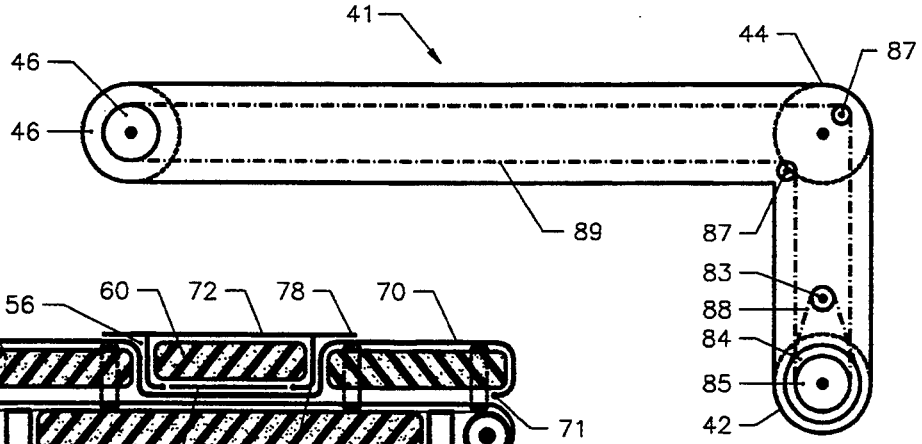

FIG. 19 is a sectional elevation view showing a chain drive system.

Figure 20:
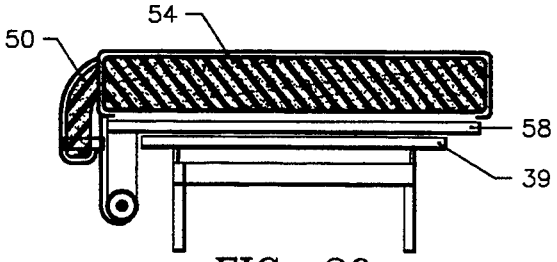

FIG. 20 is a sectional elevation view thru a stationary mattress.

Figure 21:
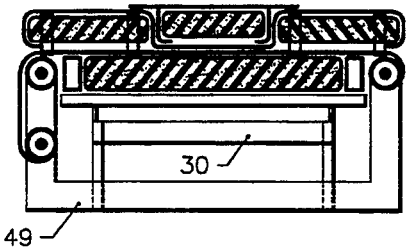

FIG. 21 is a sectional elevation view thru a floor mounted conveyor device.

Reference Numerals in Drawings

1–21 FIGS.
30–39 bed frame systems
40–49 mechanical
50–59 mattress
60–69 turntable
70–79 bed sheet
80–89 drive system

DESCRIPTION OF THE INVENTION

Figure 1:
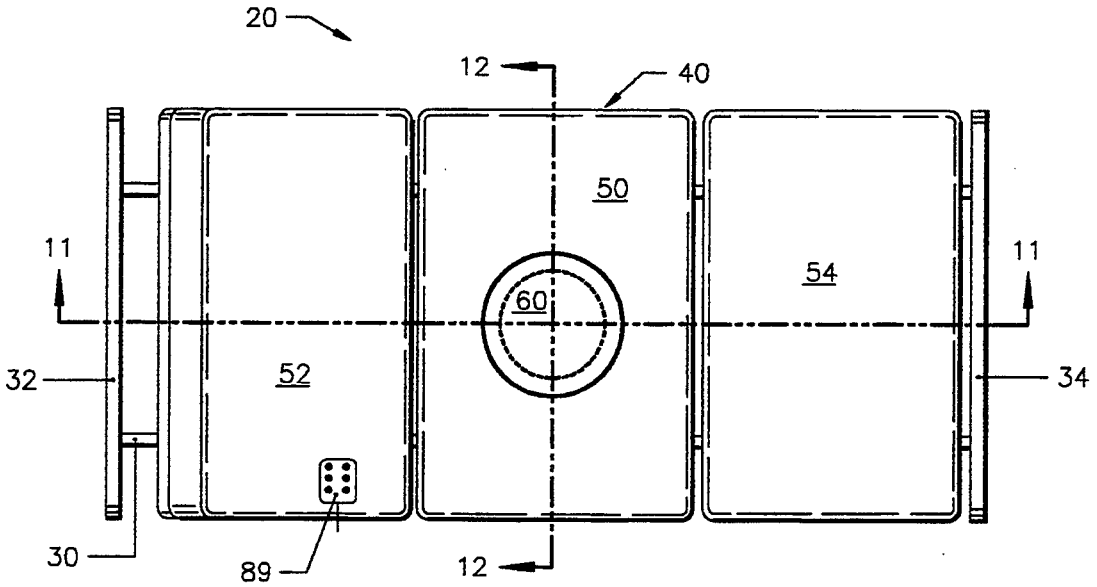
FIG. 1 is a plan view of a person conveyor positioned for a patient to lay on the center of the bed, of this invention.
Figure 2:
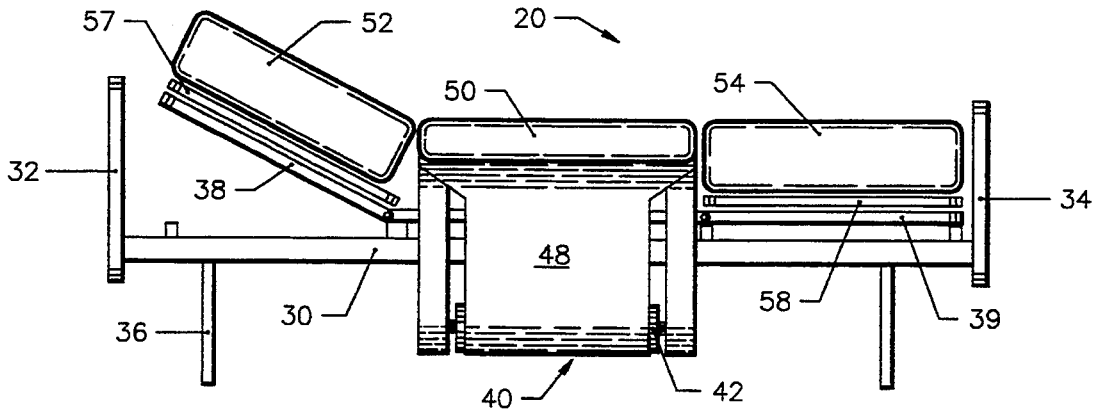
FIG. 2 is an elevation view of the conveyor of FIG. 1.
Figure 3:
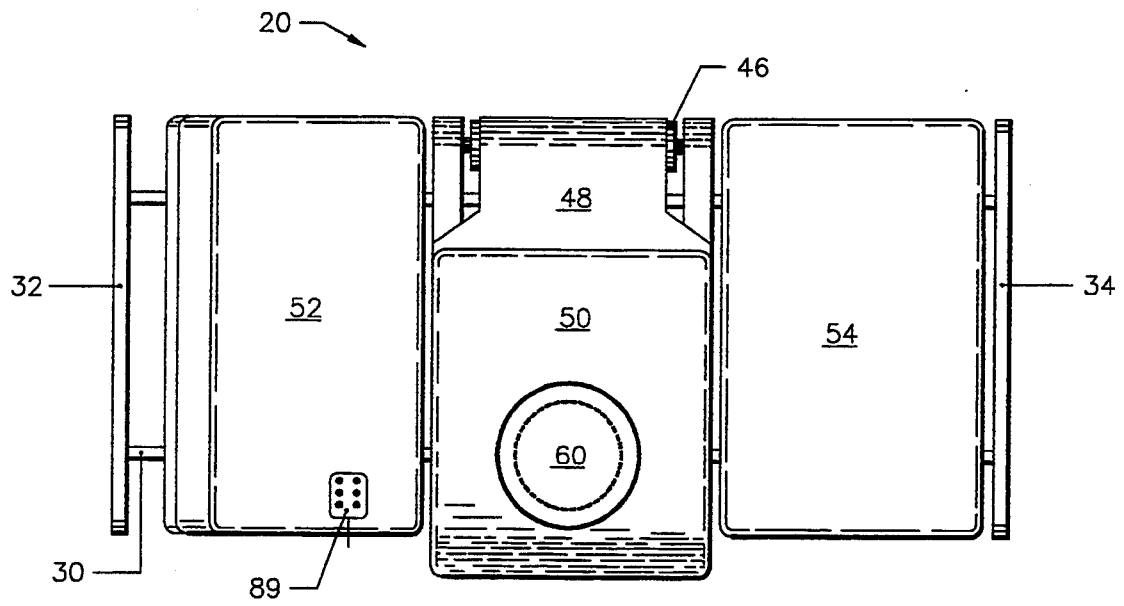
FIG. 3 is a plan view of the conveyor of FIG. 1 positioned for a patient to sit or lay on one side of the bed.
Figure 4:
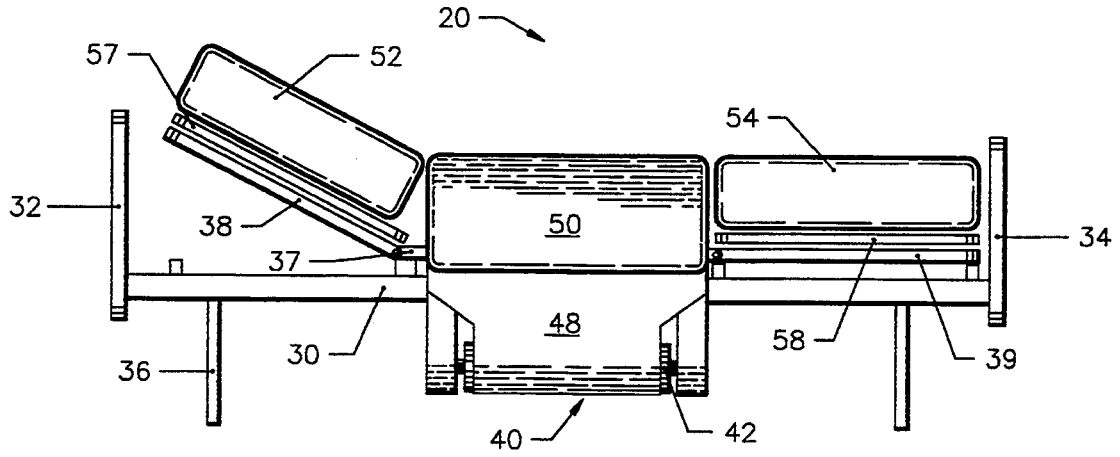
FIG. 4 is an elevation view of the conveyor of FIG. 3.
Figure 9:
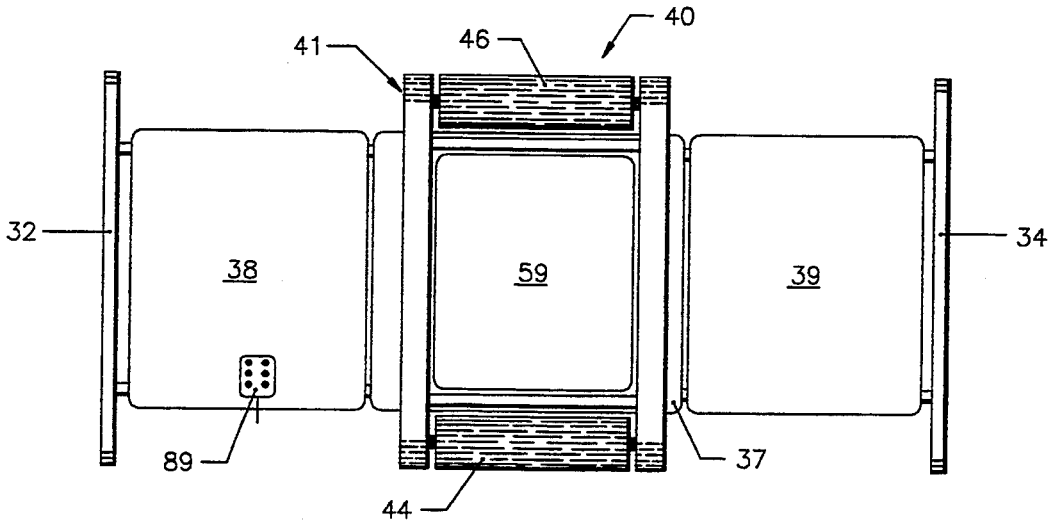
FIG. 9 is a plan view of the structure of a person conveyor shown with the mattresses and conveyor belt removed.
Figure 10:
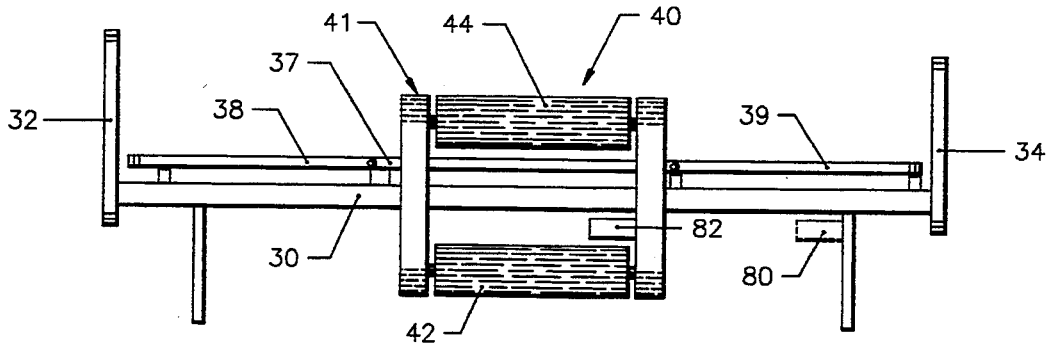
FIG. 10 is an elevation view of the conveyor device of FIG. 9.

A preferred embodiment 20 of the present invention is illustrated in FIG. 1 (plan view) and FIG. 2 (elevation view). The bed frame 30 depicts an articulating bed with adjustable head platform 38 and foot platform 39. Also shown are head board 32, foot board 34, and the bed frame legs 36. Conveyor device 40 contains direction changing means or idler roller 44 (FIG. 9) and drive rollers 42 and 46 (FIGS. 3 and 4). The top of idler roller 44 and drive roller 46 are level with the top of structural frame 41 (FIGS. 9 and 10). A flexible sheet of material or conveyor belt 48 extends across structural frame 41, drive roller 46, and idler roller 44. The ends of conveyor belt 48 are wrapped around and attached to drive rollers 42 and 46. The traveling conveyor mattress 50 on which a patient sits or lays is shown on top of conveyor belt 48. Optional cylindrical mattress turntable 60 is shown within the traveling conveyor mattress 50. In elevation view FIG. 2 shows conveyor belt 48 disposed vertically up the side of conveyor device 40. This area does not contain traveling conveyor mattress 50 so as to allow conveyor belt 48 to wrap around drive roller 42. An increase in the distance between idler roller 44 and drive roller 42 will result in an equal increase in the distance of travel of the traveling conveyor mattress 50 across the bed. Upon activating control pendant 89 conveyor belt 48, mattress 50, and the patient are transferred transversely across the bed in one direction by the pulling of drive roller 42 and in the other direction by drive roller 46. Stationary head mattress 52 and foot mattress 54 are placed on mattress extension platforms 57 and 58 which allows for an increase of overall bed width to equal that of conveyor device 40.

FIG. 3 and FIG. 4 illustrates embodiment 20 with conveyor device 40 as shown in FIG. 1 and FIG. 2 but with traveling conveyor mattress 50 shifted to one side of the bed. A user mounts and dismounts the bed when traveling conveyor mattress 50 is in this position. Upon activating control pendant 89 conveyor belt 48, mattress 50, and the patient are transferred transversely across the bed by the pulling of drive roller 46.

Figure 5:
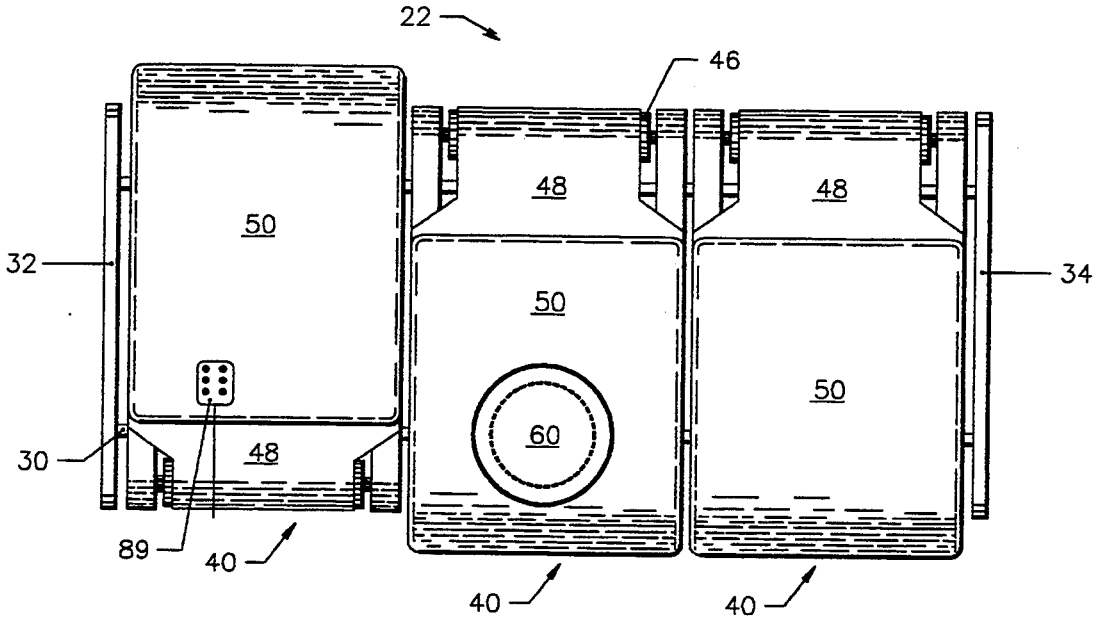
FIG. 5 is a plan view of a person conveyor comprising three separate conveyor devices.
Figure 6:
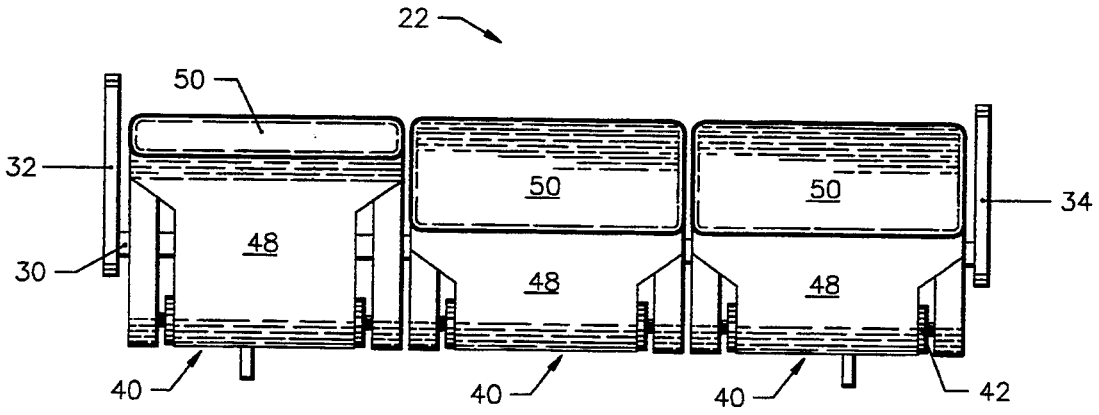
FIG. 6 is an elevation view of the conveyor of FIG. 5.

An alternate embodiment 22 of the present invention is illustrated in FIG. 5 (plan view) and FIG. 6 (elevation view). This embodiment is a method of arranging a plurality of conveyor devices 40 so that a patient may be partially rotated about the surface of the bed. The bed frame 30 is depicted with three identical conveyor devices 40 installed on it. In this configuration a user may by activating control pendant 89 and cross controlling the conveyor devices partially rotate his or her body about the surface of the bed. Optional cylindrical mattress turntable 60 may be included in the traveling conveyor mattress 50 if desired.

Figure 7:
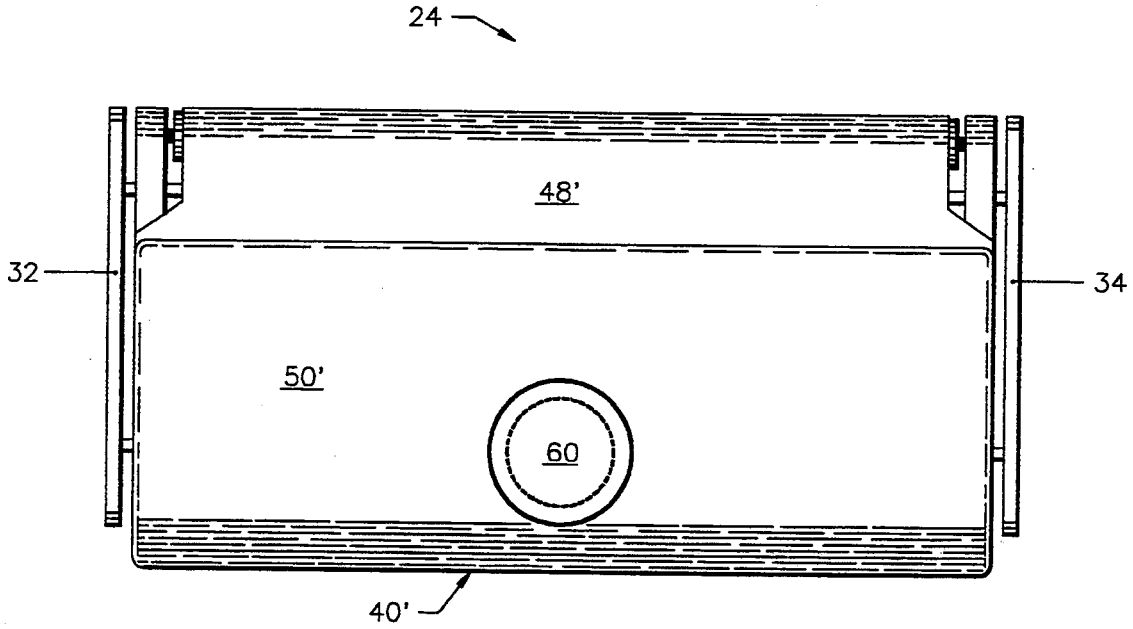
FIG. 7 is a plan view of a person conveyor comprising a single bed length conveyor device.
Figure 8:
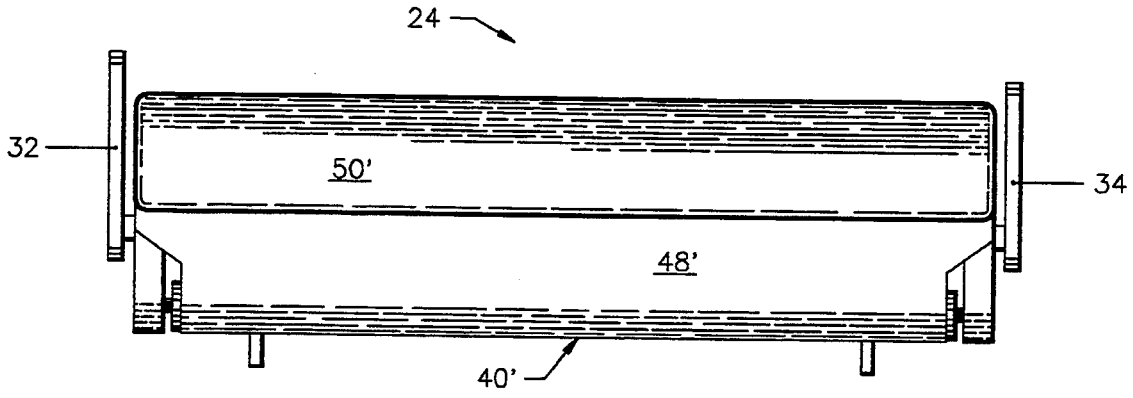
FIG. 8 is an elevation view of the conveyor of FIG. 7.

An additional alternate embodiment 24 of the present invention is illustrated in FIG. 7 (plan view) and FIG. 8 (elevation view). Conveyor device 40' is similar in design and operation to conveyor devices 40 of the previous Figures but is stretched in length to cover all of a conventional flat bed. Conveyor belt 48' and traveling conveyor mattress 50' are increased in length accordingly. Optional cylindrical mattress turntable 60 may be included if desired.

FIG. 9 and FIG. 10 illustrates bed frame 30, platforms 37, 38, and 39, conveyor device 40, drive rollers 42 and 46, less conveyor belt 48, traveling conveyor mattress 50, and stationary mattress 52 and 54 as shown in previous Figures. Items not previously shown are idler roller 44, conveyor belt cushion 59, drive motor 80, and relocated drive motor 82. Resilient cushion 59 fits within the conveyor device 40 structural frame 41 to support conveyor belt 48 and traveling conveyor mattress 50. A plain flat surface of many materials may be used in place of resilient cushion 59. Illustrated drive motor 80 is one furnished with articulating bed frame 30 for powering one of its functions. It may be removed from its original location and relocated to drive conveyor device 40. The switches on control pendant 89 originally controlling motor 80 now control relocated motor 82. However, the conveyor device may contain its own motor and controls leaving the bed's motor and controls intact.

Figure 11:
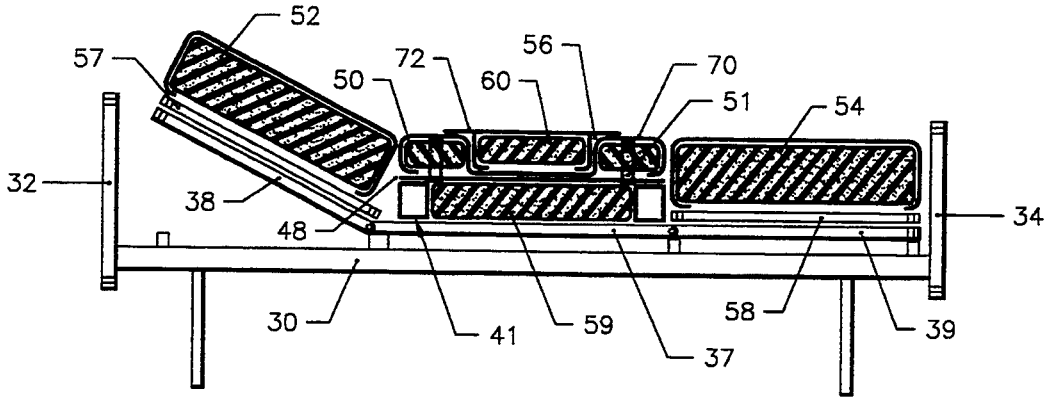
FIG. 11 is a sectional elevation view of the conveyor of FIG. 1 showing a longitudinal view.

FIG. 11 is a medial sectional elevation view taken at 11—11 on FIG. 1. Resilient cushion 59 fits inside of conveyor device 40 structural frame 41, on top of center platform 37, and underneath conveyor belt 48. It provides a buoyant surface for conveyor belt 48 to ride on thus augmenting the cushioning effect of traveling conveyor mattress 50 above. The traveling conveyor mattress 50 with the optional cylindrical mattress turntable cutout 56 and the cylindrical mattress turntable 60 is attached on top of conveyor belt 48 with connectors 51. Form fitted sheet 70 covers traveling conveyor mattress 50 and form fitted sheet 72 covers cylindrical mattress turntable 60.

FIG. 12 is a sectional elevation view taken at 12—12 on FIG. 1. Traveling conveyor mattress 50 centered on conveyor device 40 is mounted on bed frame 30 and attached to conveyor belt 48. This is the position of the traveling conveyor mattress 50 when a patient is laying on the center of the bed. One end of conveyor belt 48 is attached to drive roller 42 and the other end to drive roller 46. It rides over idler roller 44 and cushion 59.

Figure 13:
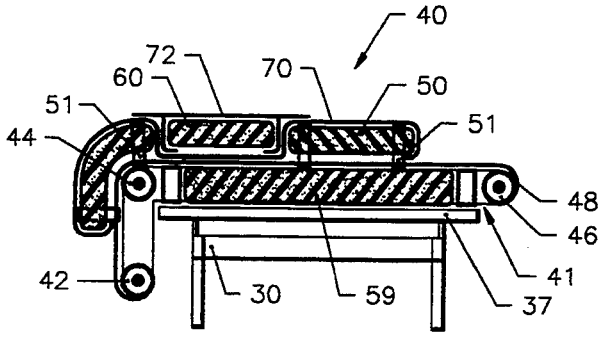
FIG. 13 is a sectional elevation view of the conveyor of FIG. 3 showing a transverse view.

FIG. 13 is a similar sectional elevation as that of FIG. 12 except that traveling conveyor mattress 50 has been shifted to one side of the bed. This is the position for a user to mount or dismount the bed. Since the mattress travels vertically down the bed side it offers protection to the patients legs as the transfer to and from another device is being performed.

Figure 14:
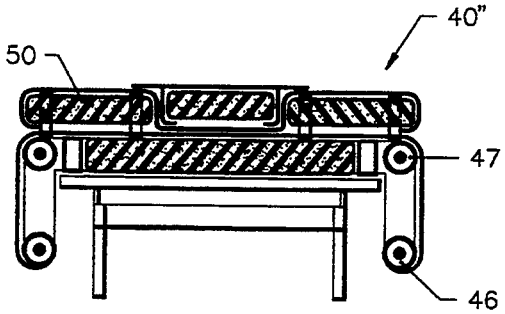
FIG. 14 is an alternate detail to the last view.

FIG. 14 is an alternate sectional elevation view showing conveyor device 40'' with drive roller 46 below idler roller 47. This configuration allows the center of traveling conveyor mattress 50 to be shifted near either side of the bed.

For wider beds additional conveyor belt 48 travel is required for shifting the center of traveling conveyor mattress 50 to the side of the bed. FIG. 15 shows conveyor device 40'' with drive roller 42 located between idler roller 44 and idler roller 45. In this design conveyor belt 48 and traveling conveyor mattress 50 travel vertically downward, around idler roller 45, then up to drive roller 42.

An alternate method for increasing conveyor belt travel is shown in FIG. 16. Conveyor device 40'''' is mounted above center platform 37 on legs 43 with enough clearance for traveling conveyor mattress 50 and continuous conveyor belt 48'' to pass between conveyor device 40'''' structural frame 41'''' and platform 37.

FIG. 17 shows mechanical components including drive rollers 42 and 46 as an integral part of bed frame 37' and legs 36' rather than being a conveyor device 40 that mounts on an existing bed. Design of the previous FIGS. can also be incorporated as an integral part of a bed rather than a conveyor device for mounting on an existing bed.

FIG. 18 illustrates in enlarged cross section view traveling conveyor mattress 50, cylindrical mattress turntable 60, and bed sheet 70. Traveling mattress 50 attaches to conveyor belt 48 with connector 51. Connector 51 is a strap of material having hook and loop or other fastening devices on its ends. The strap penetrates the mattress and the conveyor belt connecting the two together. Sheet 70 is fitted to drop into and cover cylindrical mattress turntable cutout 56. Edges of sheet 70 are held in place with elastic, Velcro ®, or other fastening devices 71. Sheet 72 with optional edges 78 for overlapping sheet 70 covers cylindrical mattress turntable 60. Sidewalls 74 of sheet 72 and bottom 62 of cylindrical mattress turntable 60 may be made of slippery material to facilitate easy rotating of the patient.

FIG. 19 shows a cutaway view of a typical chain drive arrangement. Illustrated is one end of conveyor device 40 structural frame 41. Drive sprocket 83 on drive motor 82 (FIG. 10) powers chain 88 to turn sprocket 84 connected to sprocket 85 and drive roller 42. Sprocket 85 drives chain 89 over idler sprockets 87 and around drive sprocket 86 which is connected to drive roller 46. In the background in broken line are drive rollers 42 and 46 and idler roller 44. Alternate drive systems include individual electric, hydraulic, or pneumatic motors on each drive roller.

The areas of the bed not covered by the traveling conveyor mattress are provided with stationary mattresses similar to conventional mattresses. FIG. 20 shows stationary foot mattress 54 positioned on extension platform 58 mounted on platform 39. In the background is traveling conveyor mattress 50. This illustrates the need for extension platform 58 which extends past foot platform 39 for supporting the edges of mattress 54. The same requirement applies to the platform supporting the head mattress.

Some beds are structurally deficient for carrying the load of bed mounted conveyor devices. FIG. 21 shows conveyor device 49 floor mounted. Features of many of the previous Figures. can be incorporated into this embodiment.

SUMMARY OF THE INVENTION

Accordingly, the reader will see that the present invention describes several systems which are similar in operation for moving a patient in either a sitting or prone position laterally (across the width) of a bed to a preferred position on the bed. The system is designed with a drive roller on each side of the bed. A flexible conveyor belt is spread across the width of the bed and connects to the drive roller in each side of the bed. A traveling conveyor mattress attached to the conveyor belt prevents a user from feeling the hard mechanical equipment below. A bed sheet is placed on top of the traveling conveyor mattress. Motorized turning equipment is connected to each of the rollers. By operating the turning equipment controls the patient can move him or herself back and forth across the bed. When two or more of the conveyor devices are used on the same bed a patient may be partially rotated about the surface of the bed by cross controlling them.

The identical principles as described above can be applied to a longitudinal system except that the rollers would be placed at the foot and the head of the bed.

The center area of the mattress on which the users torso lays may have a cutout in which a cylindrical section of mattress is placed. This feature is useful for rotating a user about the surface of the bed. A special form fitted sheet covers the cutout and a separate form fitted sheet fits the cylindrical section of the mattress.

Preferred embodiments and variances have been suggested for this invention. Other modifications may be made, as by adding, combining, deleting, or subdividing components, parts, or steps, while retaining advantages and benefices of the present invention.

We claim:

1. A person conveyor system (20) for a bed comprising:

a bed frame (30);

a traveling mattress (50) on which a user may sit or lay;

a first side edge of said bed frame having a first direction changing means (44), a second side edge of said bed frame having a second direction changing means (47), a flexible sheet of material (48) extending across the top of said bed frame (30) approximately colevel with the top of said direction changing means, said traveling mattress (50) attached to the upper surface of said flexible sheet of material (48);

a first drive roller (42) and a second drive roller (46) located a distance under said direction changing means (44) and (47) respectfully, said distance an amount sufficient to allow said flexible sheet of material (48) and said traveling mattress (50) to travel across said bed frame (30) a desired amount;

a first end of said flexible sheet of material (48) disposed over said first direction changing means (44) and wrapped around and connected to said first drive roller (42), a second end of said flexible sheet of material disposed over said second direction changing means (47) and wrap, pad around and connected to said second drive roller (46);

and, driving means (82) and control means (89) for winding said flexible sheet of material (48) on either of said drive rollers (42, 46) while unwinding it from the other drive roller, said drive rollers (42, 46) pulling sail flexible sheet of material (48) and said traveling mattress (50) to a desired location on said bed.

2. A person conveyor system (20) for a bed comprising:

a bed frame (30);

a traveling mattress (50) on which a user may sit or lay;

a first side edge of said bed frame having a first direction changing means (44), a second side edge of said bed frame having a second direction changing means (47), a flexible sheet of material (48) extending across the top of said bed frame (30) approximately colevel with the top of said direction changing means, said traveling mattress (50) attached to the upper surface of said flexible sheet of material (48);

a first drive roller (42) and a second drive roller (46) located a distance under said direction changing means (44) and (47) respectfully, said distance an amount sufficient to allow said flexible sheet of material (48) and said traveling mattress (50) to travel across said bed frame (30) a desired amount;

a first end of said flexible sheet of material (48) disposed over said first direction changing means (44) and wrapped around and connected to said first drive roller (42), a second end of said flexible sheet of material disposed over said second direction changing means (47) and wrapped around and connected to said second drive roller (46);

a cylindrical opening in said traveling mattress (50) for receiving rotatable cylindrical mattress means (60), and said rotatable cylindrical mattress means (60) on which said user may sit or lay so as to ease rotating said user about the surface of said traveling mattress (50);

and, driving means (82) and control means (89) for winding said flexible sheet of material (48) on either of said drive rollers (42, 46) while unwinding it from the other drive roller, said drive rollers (42, 46) pulling said flexible sheet of material (48) and said traveling mattress (50) to a desired location on said bed.

3. A person conveyor system (20) for a bed comprising:

a conveyor device (40) for mounting on a bed frame (30);

a traveling mattress (50) on which a user may sit or lay;

a first side edge of said conveyor device (40) frame (41) having a first direction changing means (44), a second side edge of said frame (41) having a second direction changing means (47), a flexible sheet of material (48) extending across the top of said conveyor device (40) approximately colevel with the top of said direction changing means, said traveling mattress (50) attached to the upper surface of said flexible sheet of material (48);

a first drive roller (42) and a second drive roller (46) located a distance under said direction changing means (44) and (47) respectfully, said distance an amount sufficient to allow said flexible sheet of material (48) and said traveling mattress (50) to travel across said conveyor device (40) a desired amount;

a first end of said flexible sheet off material (48) disposed over said first direction changing means (44) and wrapped around and connected to said first drive roller (42), a second end of said flexible sheet of material disposed over said second direction changing means (47) and wrapped around and connected to said second drive roller (46);

and, driving means (82) and control means (89) for winding said flexible sheet of material (48) on either of said drive rollers (42, 46) while unwinding it from the other drive roller, said drive rollers pulling said flexible sheet of material (48) and said traveling mattress (50) to a desired location on said conveyor device (40).

4. A person conveyor system (20) for a bed comprising:

a conveyor device (40) for mounting on a bed frame (30);

a traveling mattress (50) on which a user may sit or lay;

a first side edge of said conveyor device (40) frame (41) having a first direction changing means (44), a second side edge of said frame (41) having a second direction changing means (47), a flexible sheet of material (48) extending across the top of said conveyor device (40) approximately colevel with the top of said direction changing means, said traveling mattress (50) attached to the upper surface of said flexible sheet of material (48);

a first drive roller (42) and a second drive roller (46) located a distance under said direction changing means (44) and (47) respectfully, said distance an amount sufficient to allow said flexible sheet of material (48) and said traveling mattress (50) to travel across said conveyor device (40) a desired amount;

a first end of said flexible sheet of material (48) disposed over said first direction changing means (44) and wrapped around and connected to said first drive roller (42), a second end of said flexible sheet of material disposed over said second direction changing means (47) and wrapped around and connected to said second drive roller (46);

a cylindrical opening in said traveling mattress (50) for receiving rotatable cylindrical mattress means (60), and said rotatable cylindrical mattress means (60) on which said user may sit or lay so as to ease rotating said user about the surface of said traveling mattress (50);

and, driving means (82) and control means (89) for winding said flexible sheet of material (48) on either of said drive rollers (42, 46) while unwinding it from the other drive roller, said drive rollers pulling said flexible sheet of material (48) and said traveling mattress (50) to a desired location on said conveyor device (40).

* * * * *